US005083353A

United States Patent [19]

Jacques

[11] Patent Number: 5,083,353

[45] Date of Patent: Jan. 28, 1992

[54] CURRENT-CONDUCTING ROLLER

[75] Inventor: Claude Jacques, Pontault-Combault, France

[73] Assignee: Polimiroir, Saint-Soupplets, France

[21] Appl. No.: 536,720

[22] Filed: Jun. 12, 1990

[30] Foreign Application Priority Data

Jun. 12, 1989 [FR] France ..... 89 07720

[51] Int. Cl.[5] ..... B21B 31/08; B60B 5/00; B60B 21/00

[52] U.S. Cl. ..... 29/132; 204/280; 29/130

[58] Field of Search ..... 29/129, 130, 132; 204/280, 290 R

[56] References Cited

U.S. PATENT DOCUMENTS

| | | | |
|---|---|---|---|
| 2,958,742 | 11/1960 | Palmer | 29/130 |
| 3,165,179 | 1/1965 | Shapland | 29/130 |

FOREIGN PATENT DOCUMENTS

| | | | |
|---|---|---|---|
| 2326490 | 12/1974 | Fed. Rep. of Germany . | |
| 0221298 | 12/1983 | Japan | 204/280 |
| 0135595 | 7/1985 | Japan | 204/280 |
| 2019127 | 4/1978 | United Kingdom . | |

*Primary Examiner*—Timothy V. Eley
*Assistant Examiner*—C. Richard Martin
*Attorney, Agent, or Firm*—Pollock, Vande Sande & Priddy

[57] ABSTRACT

A current conducting roller, in particular for a continuous electrolysis line, the roller comprising in conventional manner a steel body (120) and being characterized by the fact that it includes an inside copper fitting (130) over at least a portion of its length.

21 Claims, 1 Drawing Sheet

CURRENT-CONDUCTING ROLLER

FIELD OF THE INVENTION

The present invention relates to the field of current-conducting rollers, and particularly, but not exclusively, to rollers for continuous electrolysis lines.

STATE OF THE ART

The overall view of FIG. 1 and the fragmentary axial section view of FIG. 2 in the accompanying drawing show the structure of a conventional current-conducting roller 10 as commonly used in continuous electrolysis lines.

This roller essentially comprises a circularly cylindrical central portion 12 which constitutes the active main portion of the roller taking part in electrolysis, with said central portion of the roller being called the "barrel", and two half-shafts 14, 16 disposed at opposite ends of the central portion 12 and coaxial therewith. The half-shafts 14 and 16 are smaller in diameter than the central portion. They perform two functions: guiding rotation of the roller and also feeding the roller with electrical current.

It may be observed that an axial channel 18 passes through the rollers enabling cooling water to circulate.

More precisely, rollers are generally formed by a steel body 20 having an outer copper coating 30 for performing the current-collecting function. The steel body 20 is itself generally constituted by a circularly cylindrical central sleeve 22 receiving two steel coaxial half-shafts 26 and being welded thereto at its ends 24.

A ring 40 is also provided serving as a gasket support on each half-shaft 14, 16.

The copper coating is generally formed by electrodeposition. Providing the copper coating 30 is very difficult to perform, very time consuming, and expensive, given the thicknesses imposed by the amperages required, which amperages generally lie in the range 12,000 amps to 18,000 amps.

Attempts have been made to work around these difficulties by making the copper coating in the form of a socket which is heat-shrunk into each steel half-shaft 26. In this case, the cross-sections of the steel half-shafts 26 and of the heat-shrunk sockets are designed to co-operate in conveying the required amperage. However, it is frequently observed in practice that corrosion arises between the heat-shrunk copper socket and the corresponding supporting half-shaft. This causes the heat-shrunk copper socket to pass all of the currents on its own. Under such conditions the rollers cannot give satisfaction.

Similarly, corrosion is often observed between the central sleeve 22 and the half-shafts 26 received therein, such that current is passed solely by the weld fillet 24.

SUMMARY OF THE INVENTION

An object of the present invention is to provide a novel current-conducting roller which totally eliminates the drawbacks of the prior art.

The present invention achieves this object by means of a current-conducting roller comprising a steel body and characterized by the fact that it includes, at least over a portion of its length, an internal heat-shrink fitting made of copper.

According to an advantageous characteristic of the present invention, two internal heat-shrink fittings of copper are provided, one in each of the steel half-shafts of the roller.

According to another advantageous characteristic of the present invention, the internal heat-shrink fitting of copper is protected by a lining, e.g., of stainless steel.

BRIEF DESCRIPTION OF THE DRAWINGS

Other characteristics, objects, and advantages of the present invention appear from reading the following detailed description given by way of non-limiting example and made with reference to the accompanying drawing, in which.

DESCRIPTION OF THE PREFERRED EMBODIMENT

Figure 1:
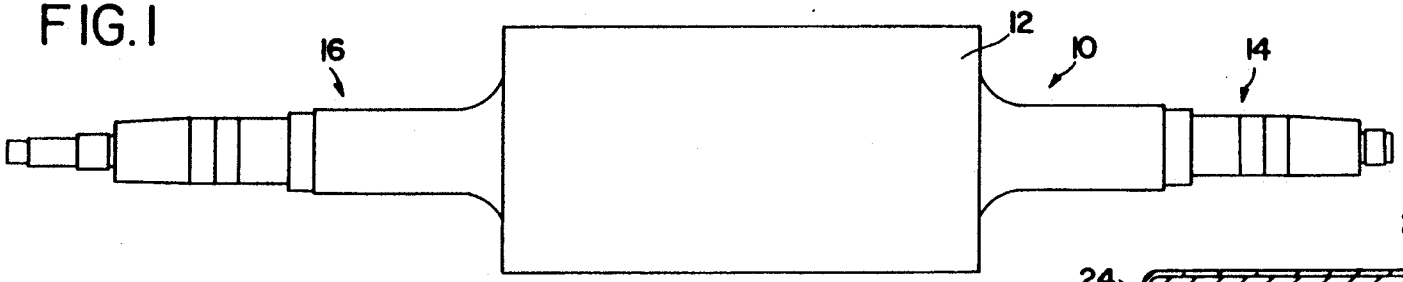
FIGS. 1 and 2 are described above and illustrate the state of the art.
Figure 2:
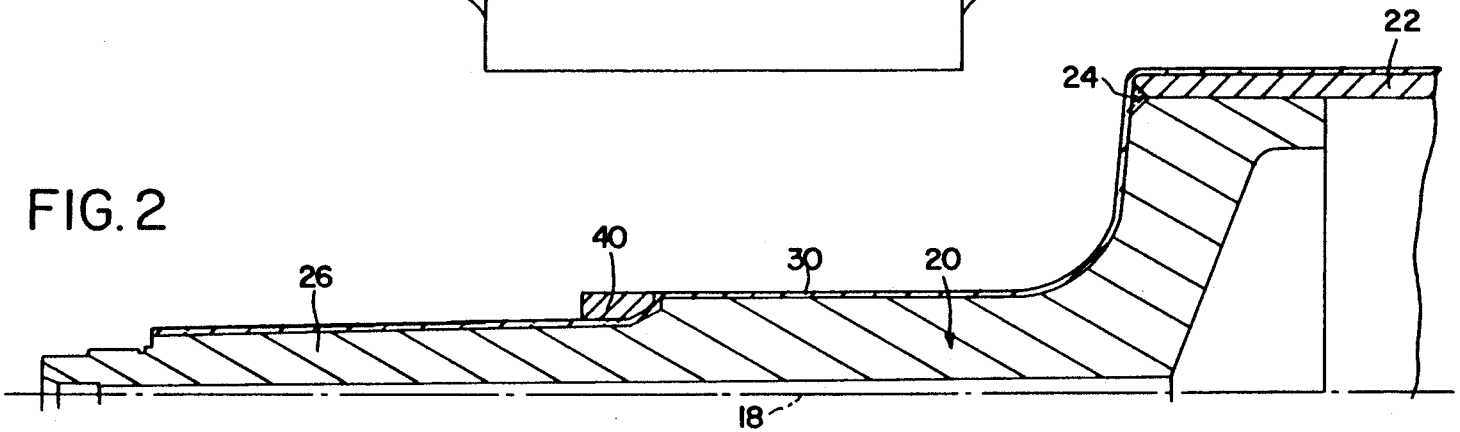
Figure 3:
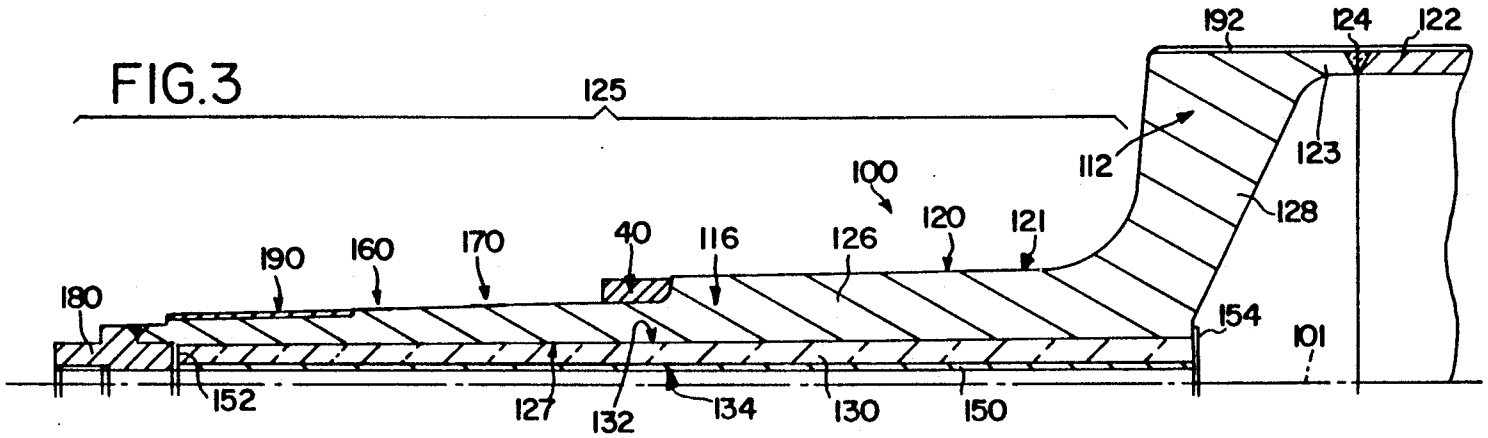
FIG. 3 is a fragmentary view in axial section through a current-conducting roller of the present invention.

The roller 100 shown in FIG. 3 has an axis referenced 101.

As mentioned above, the roller 100 essentially comprises a circularly cylindrical central portion 112 of large diameter constituting the main active portion of the roller or "barrel", together with two half-shafts (with only one half-shaft 116 appearing in FIG. 3) extending from respective ends of the central portion 112 and along its axis.

More precisely, the roller 100 comprises a steel body 120 and two internal heat-shrink copper fittings 130.

The steel body 120 is itself preferably constituted by a circularly cylindrical central sleeve 122 which is welded at each end to a respective stepped half-shaft 126 likewise made of steel. It will be observed that, unlike the prior art, the sleeve 122 does not receive the half-shafts 126 but is merely butt-welded thereto via annular fillets 124. Each of the half-shafts 126 has a through axial channel.

There are many ways in which the half-shafts 126 may be shaped, and consequently the specific shape is not described in detail below. It may be observed that the stepped cross-section of each half-shaft 126 flares from a first end constituting a current collector towards the central portion 112.

Each half-shaft 126 essentially comprises an axially outer portion 125, an axially inner portion 123, and a transition zone 128 therebetween. The axially outer portion 125 comprises a succession of cylindrical portions with the section thereof increasing towards the barrel 112. It has a circularly cylindrical inside surface referenced 127 of constant diameter about the axis 101. The axially inner portion 123 is of larger inside diameter than the axially outer portion 125. The radius of the axially inner portion 123 is equal to that of the sleeve 122. It is welded thereto by a fillet 124. The transition zone 128 flares away from the axis 101 going towards the axially inner portion 123.

The transition zone 128 provides current flow on its own. In other words, no copper part assists in passing current across this transition zone. The cross-section of the steel transition zone must therefore be adequate.

Two internal copper heat-shrink fittings 130 are placed inside the axially outer portions 125 of each of the steel half-shafts 126. The circularly cylindrical outer surfaces 132 of the fittings 130 are complementary to the inside surfaces 127 of the half-shafts 126 in order to ensure intimate electrical contact between the half-shafts 126 and their inside fittings 130.

In order to reinforce this electrical contact, a deposit of silvering may be provided between the half-shafts 126 and their inside fittings 130. The deposit of silvering may consequently be formed either on the outer surfaces 132 of the fittings 130 or else on the inner surfaces 127 of the half-shafts 126.

The copper fittings 130 are protected from the cooling water, generally carbonated water, and also from chromic acid during chromium plating operations on the bearing surfaces, the gaskets, and the barrel surface of the roller, by means of a lining 150 which is preferably made of stainless steel.

The circularly cylindrical lining 150 is complementary to the inner surface 134 of the fittings 130.

Each fitting 130 is further protected by two washers 152 and 154 disposed transversely to the axis 101 and each covering a corresponding end of the fitting and welded at their inside peripheries to the lining 150 and at their outside peripheries to the half-shafts 126.

In addition to enabling manufacture to be fast and cheap, the use of such an internal copper fitting serves to guarantee that the required amperages can be passed. By virtue of the protection provided by the lining 150, no corrosion can take place between the half-shafts 126 and the fittings 130.

The outer surface 121 of each half-shaft 126 is preferably chromium plated.

Thus, the conventional ring 40 acting as a gasket support and shown by way of example in FIG. 3 may be omitted. The chromium plated outer surface 121 of each steel half-shaft 126 may itself constitute a gasket-supporting surface.

The roller structure proposed by the present invention leaves the steel body 120 accessible from the outside such that the screw threads 160 and 170 conventionally formed in the half-shafts may be formed directly in the steel half-shafts 126 instead of being formed in a portion of the copper on the half-shafts as has been the case in the prior art. It will be understood that the mechanical strength of these threads is thus much greater in the context of the present invention. There are numerous different possible embodiments of these threads both in number and in disposition, and they are therefore not described in detail below. These threads may be used, for example, for locking bearing means or collector means in place.

An end piece 180 is preferably applied by heat shrinking and fixed by welding to each projecting end of the half-shafts 126.

As shown in accompanying FIG. 3, it will be observed that the connection between each endpiece 180 and the associated half-shaft 126 is such that the inside copper fitting 130 extends over the entire extent of the current collector.

Where applicable, a coating 190 may be deposited by electrodeposition on the current-collector forming portion of the outer surface of each steel half-shaft 126. Similarly, a coating 192 may be deposited by electrodeposition on the larger diameter central sleeve 122, as shown in accompanying FIG. 3. The copper coating 192 may facilitate the performance of subsequent shot-blasting.

However these coatings 190 and 192 are not essential. Further, insofar as they do not provide a major fraction of the contribution to passing the required amperages, they may be of greatly reduced thickness. The time required to make them and their cost are consequently much less than the time and cost applicable to a conventional coating 30.

By way of example, for a roller intended for a continuous electrolysis line, the following sections may be provided:

the section of each steel half-shaft 126 level with the current collector forming portion: about 8,370 $mm^2$;

the section of the inside copper fitting: about 3,000 $m^2$; and the section of each steel half-shaft 126 in the transition zone between the cylindrical portion in contact with a fitting 130 and the portion welded to the central sleeve 122: not less than about 8,150 $mm^2$.

I claim:

1. A current conducting roller comprising a steel body constituted by a large diameter central cylindrical portion having two ends and two coaxial half-shafts located respectively on said ends of said central cylindrical portion, each of said half-shafts having a through axial channel and two inside copper fittings provided, respectively, in each through axial channel of said half-shafts.

2. A roller according to claim 1, wherein said inside copper fittings are each protected by a lining.

3. A roller according to claim 2, wherein said lining is made of stainless steel.

4. A roller according to claim 2, further including two washers at the ends of each lining, said washers reinforcing the protection of the fittings.

5. A roller according to claim 1, wherein an outer surface of said steel body is chromium plated.

6. A roller according to claim 1, wherein an outer surface of said steel body serves as a gasket support.

7. A roller according to claim 1, wherein an outer surface of said steel body is provided with screw threads.

8. A roller according to claim 1, wherein a deposit of silvering is provided between said inside copper fittings and said half-shafts of said steel body.

9. A roller according to claim 1, wherein it includes a thin outer deposit of copper over a current collector zone, said deposit being formed by electrodeposition.

10. A roller according to claim 1, including a thin outer deposit of copper over a central cylindrical portion of said roller, said deposit being formed by electrodeposition.

11. A current conducting roller comprising a steel body constituted by a large diameter central cylindrical portion having two ends and two coaxial half-shafts located respectively on said ends of said central cylindrical portion, each of said half-shafts having a through axial channel, two inside copper fittings provided, respectively, in each through axial channel of said half-shafts, and a protective lining in each of said copper fittings.

12. A roller according to claim 11, wherein a deposit of silvering is provided between said inside copper fittings and said half-shafts of said steel body.

13. A current conducting roller comprising a steel body constituted by a large diameter central cylindrical portion having two ends and two coaxial half-shafts located respectively on said ends of said central cylindrical portion, each of said half-shafts having a through axial channel, two inside copper fittings provided, respectively, in each through channel of said half-shafts and a deposit of silvering provided between said inside copper fittings and said half-shafts.

14. A roller according to claim 13, wherein said inside copper fittings are each protected by a lining.

15. A roller according to claim 11 or 14, wherein said lining is made of stainless steel.

16. A roller according to claim 11 or 14, further including two washers at the ends of each lining, said washers reinforcing the protection of the fittings.

17. A roller according to claim 11 or 13, wherein an outer surface of said steel body is chromium plated.

18. A roller according to claim 11 or 13, wherein an outer surface of said steel body serves as a gasket support.

19. A roller according to claim 11 or 13, wherein an outer surface of said steel body is provided with screw threads.

20. A roller according to claim 11 or 13, wherein it includes a thin outer deposit of copper over a current collector zone, said deposit being formed by electrodeposition.

21. A roller according to claim 11 or 13, including a thin outer deposit of copper over a central cylindrical portion of said roller, said deposit being formed by electrodeposition.

* * * * *